United States Patent [19]

Darby et al.

[11] 4,181,196

[45] Jan. 1, 1980

[54] METHOD AND APPARATUS FOR RECOVERY OF SUBSEA WELL EQUIPMENT

[75] Inventors: Lacy B. Darby, Houma; Joseph A. Holley, Gretna, both of La.

[73] Assignee: Exxon Production Research Company, Houston, Tex.

[21] Appl. No.: 809,337

[22] Filed: Jun. 23, 1977

[51] Int. Cl.[2] ..... E21B 7/12; E21B 43/01

[52] U.S. Cl. ..... 166/361; 166/297; 166/299; 166/55

[58] Field of Search ..... 102/22, 23; 166/0.5, 166/63, 297, 299, 301, 55, 298, 365, 366, 356, 361

[56] References Cited

U.S. PATENT DOCUMENTS

| | | | |
|---|---|---|---|
| 3,057,295 | 10/1962 | Christopher | 166/55 X |
| 3,145,775 | 8/1964 | McCarty | 166/0.5 |
| 3,163,217 | 12/1964 | Haeber | 166/0.5 |
| 3,376,927 | 4/1968 | Brown | 166/0.5 |
| 3,983,936 | 10/1976 | Kennard et al. | 166/55.8 X |
| 3,987,638 | 10/1976 | Burkhardt | 166/366 |
| 4,042,019 | 8/1977 | Henning | 166/55 |

*Primary Examiner*—James A. Leppink
*Assistant Examiner*—Richard E. Favreau
*Attorney, Agent, or Firm*—J. S. Schneider

[57] ABSTRACT

Method and apparatus are disclosed for recovering submerged equipment, such as a guide base and wellhead used in offshore well operations. A recovery tool, which includes an elongated member capable of extending from above the equipment into a well pipe and means for latching the recovery tool to the equipment and explosive means attached to the elongated member for severing the well pipe, is lowered from the water's surface to the equipment and then latched thereto. The explosive is then detonated to sever the well pipe. The recovery tool, together with the equipment and severed portion of the well pipe, is raised to the water's surface.

9 Claims, 7 Drawing Figures

FIG. IA.

FIG. 5.
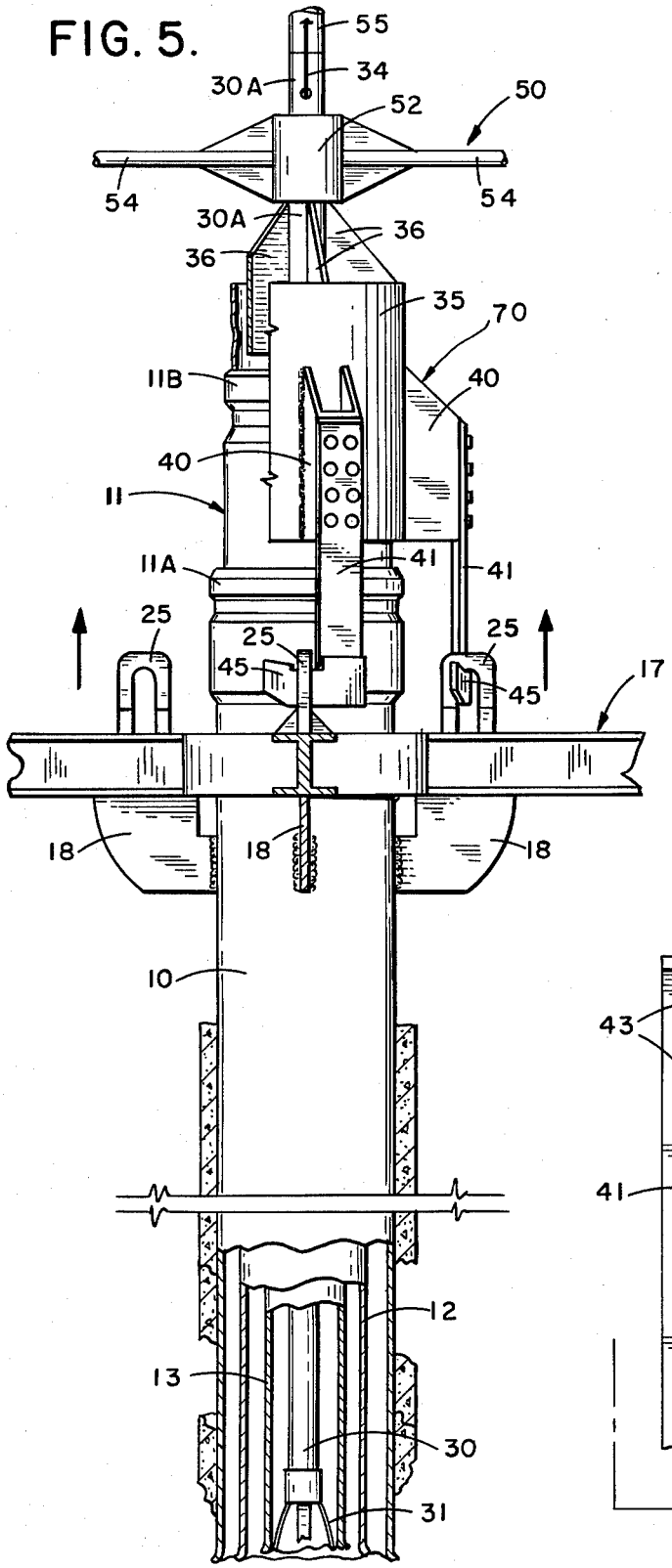
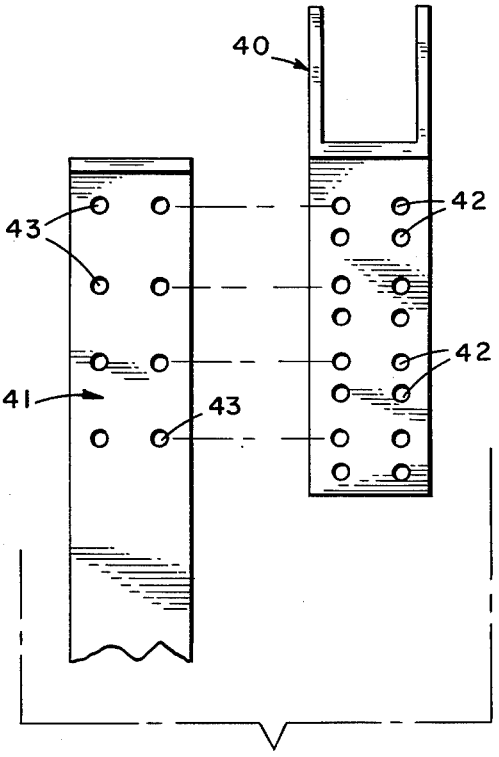
FIG. 6.

METHOD AND APPARATUS FOR RECOVERY OF SUBSEA WELL EQUIPMENT

BACKGROUND OF THE INVENTION

The present invention concerns method and apparatus for recovering subsea well equipment and, in particular, recovering a submerged wellhead and guide base without the use of divers.

The primary purpose the the present invention is to eliminate the necessity of using divers to recover subsea guide bases and wellheads. Well pipe suspended from a subsea wellhead and cemented in the subsea borehole prevents recovery of the wellhead and its associated guide base until the upper portion of the well pipe is severed from the lower portion of the well pipe. Heretofore, an expensive dive was necessary so that a diver could attach a wire rope or sling to the subsea guide base and wellhead and install an explosive charge in the well pipe. The present invention eliminates the need for the expensive diver service completely. In addition, the present invention also provides the capability of the recovery of wellheads and guide bases in depths of water beyond the practical depth limitations of divers.

SUMMARY OF THE INVENTION

In accordance with the invention, the apparatus for recovering subsea equipment, which is secured to a well pipe suspended in a subsea borehole, includes a recovery tool comprising an elongated member extendible from above the equipment into the well pipe, means attached to the elongated member for latching the recovery tool to the apparatus and explosive means on the elongated member for severing the well pipe at a predetermined depth in the borehole. Means are also included for detonating the explosive means and means is provided on the equipment for engaging the tool latching means.

In operating the apparatus for the invention, the recovery tool is lowered from the water's surface to the level of the equipment and the elongated member is guided through the equipment into the well pipe. The latch means on the recovery tool is connected to the engaging means on the equipment, the explosive is detonated to sever the well pipe and the elongated member is raised to the water's surface, along with the equipment and the severed upper portion of the well pipe.

BRIEF DESCRIPTION OF THE DRAWINGS

FIGS. 1 and 1A are elevational views illustrating the recovery tool of the invention being lowered into position on the wellhead;

FIG. 5 is an enlarged view of a leg and spacer block for vertically adjusting the legs; and FIG. 6 is an elevational view illustrating raising of the recovery tool of the invention, along with the wellhead, guide base and severed well pipe.

DESCRIPTION OF THE PREFERRED EMBODIMENTS

Figure 1:
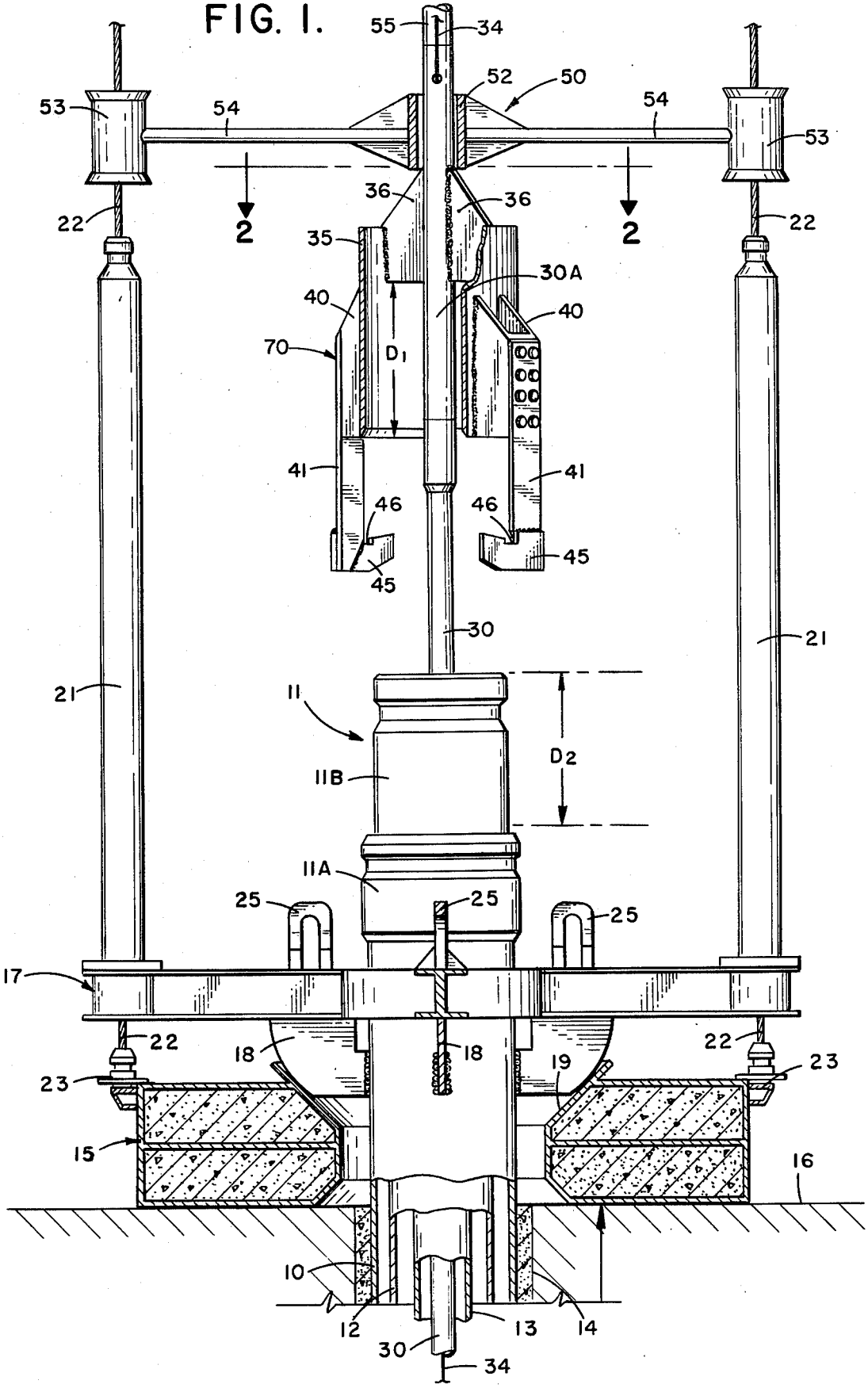
Figure 2:
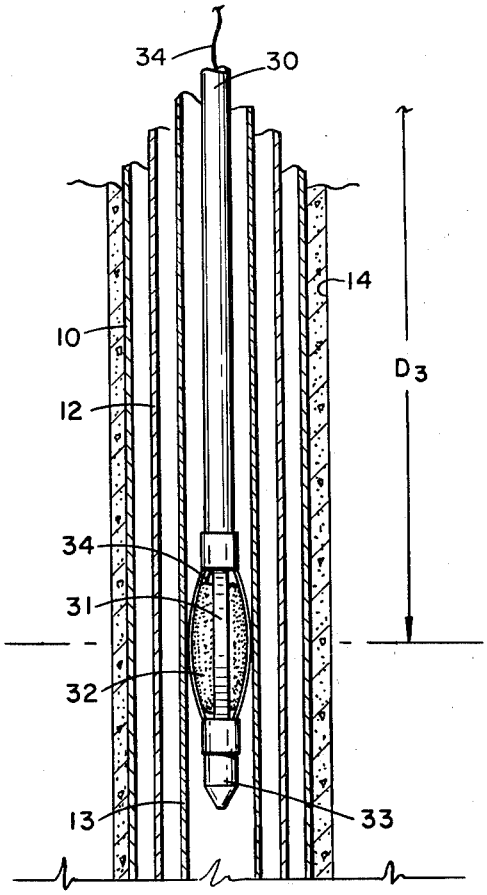
FIG. 2 is a view taken along lines 2—2 of FIG. 1.
Figure 2:
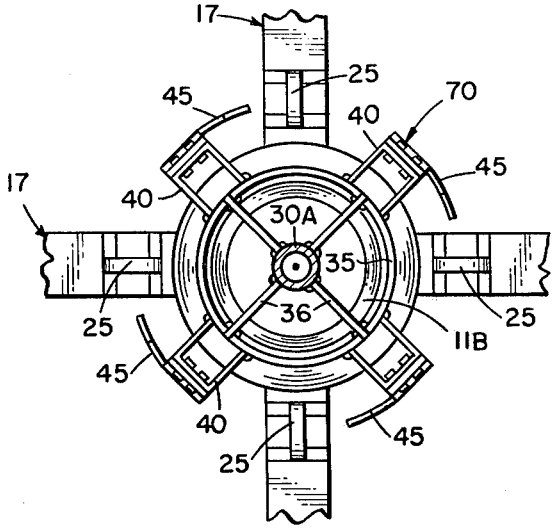

There are shown in FIGS. 1 and 1A a structural casing pipe 10, conductor casing pipe 12 and surface casing pipe 13 all suspended from a wellhead assembly

11 and cemented in a subsea borehole 14. A temporary guide base 15 is positioned on the ocean floor 16 and supports a permanent guide base 17. Wellhead assembly 11 includes a lower housing 11A and an upper housing 11B, smaller in diameter than the diameter of housing 11A. Housing 11A is attached to permanent guide base 17 and supported by curved gussets 18 on the tapered surface 19 of guide base 15. Guide base 17 includes four guide posts 21 through each of which a guide cable 22, connected to guide base 15 at 23, extends to the surface of the water, not shown.

Four pad eyes or catches 25 are welded, or otherwise secured, to guide base 17 before the guide base is installed on the ocean floor. The four pad eyes are, preferably, spaced equidistant from each other about wellhead assembly 11.

A recovery tool, generally designated 70, includes an elongated tubing or pipe 30 which extends through wellhead assembly 11 into surface casing pipe 13. Pipe 30 has a conventional centralizer 31 attached to its lower end which contains an explosive charge 32. A nose 33 is connected to the lower end of centralizer 31. One end of an electrical lead 34 is connected to explosive charge 32 and the other end is connected to a source of electrical energy, not shown, at the water's surface. Lead 34 is, preferably, contained within pipe 30 in the portion of pipe 30 below and adjacent to wellhead 11. Lead 34, as seen in FIG. 1, passes through an opening in an enlarged upper portion 30A of pipe 30. The upper end of portion 30A is connected to the lower end of a (drill) pipe 55 which extends to the water's surface.

Figure 3:
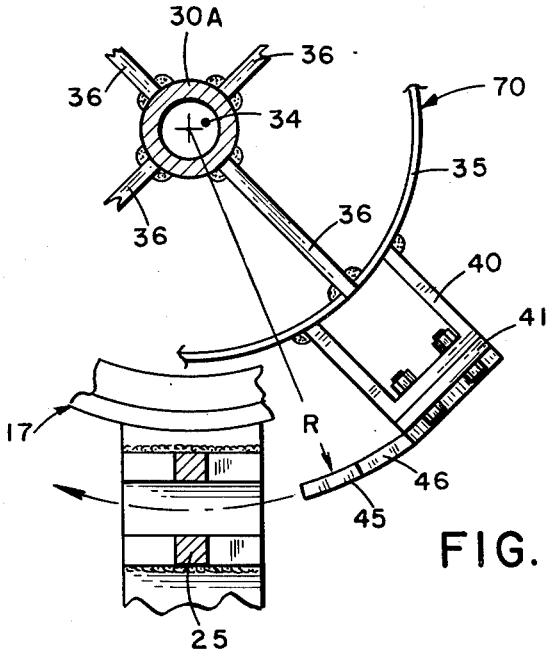
FIG. 3 is an enlarged fragmentary view of a portion of FIG. 2.

A cylindrical frame 35 is secured to pipe 30A by gussets 36. Four spacer blocks 40 (see also FIGS. 3 and 5) are welded onto cylinder frame 35. These blocks are spaced angularly about cylinder frame 35 in the same angular positioning that pad eyes are arranged about wellhead assembly 11. A leg member 41 is bolted to each spacer block 40. As shown in FIG. 6, holes 42 in spacer block 40 are arranged for alignment with holes 43 in leg 41 to permit vertical adjustment of leg 41 relative to spacer block 40. A circularly curved foot 45 is welded to the lower end of each leg 41 to form a latch or hook. Each foot 45 is curved to a radius R and formed with a recessed portion 46 to facilitate latching of each foot 45 to one of the pad eyes 25 (see also FIG. 4).

A guide device, generally designated 50, includes a cylindrical member 52, which surrounds pipe 30; guide sleeves 53, through which guide cables 22 extend; and connecting rods 54, which connect cylindrical member 52 to guide sleeves 53. Guide device 50 is supported on recovery tool 70, cylindrical member 52 resting the weight of guide device 50 on gussets 36. Electrical lead 34 extends to the water's surface along the exterior of drill pipe 55.

OPERATION

When it is desired to abandon well bore 14 the recovery tool, including an explosive charge 32 connected to tubing 30, is lowered to subsea wellhead 11 on drill pipe 55, guided by the guide device 50, until the bottom of gussets 36 abut the top of wellhead 11. Each leg 41 and its associated foot 45 are positioned between two pad eyes. Feet 45 are on the same level as pad eyes 25 and radially aligned with the openings therein. Orientation of the recovery tool with respect to the wellhead is achieved when the recovery unit is permitted to rotate relative to wellhead 11 by use of TV cameras (not shown) employed to position each foot 45 between each adjacent pair of pad eyes 25. Drill pipe 55 is then rotated clockwise at the water's surface to rotate tubing 30A and legs and feet 41 and 45, respectively, to insert each foot 45 in the opening in pad eye 25 in its path.

Figure 4:
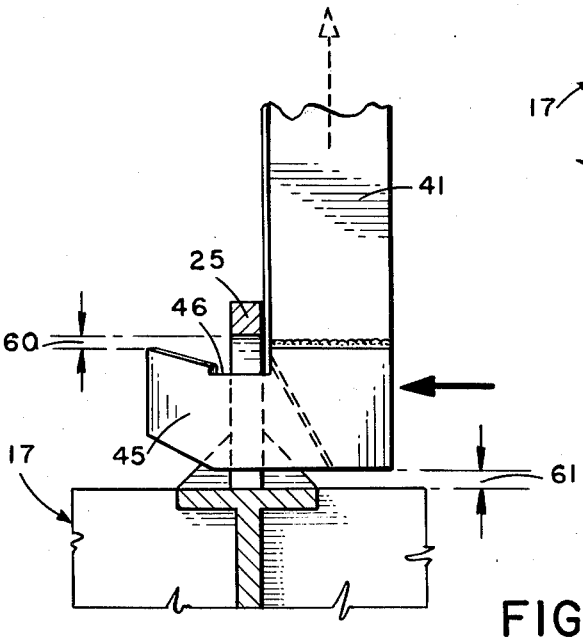
FIG. 4 is an enlarged fragmentary view of one foot and one pad eye.

Referring now to FIG. 4, an upper space indicated at 60 and a lower space indicated at 61, above and below each foot 45 in pad eye 25, insure insertion of each foot 45 in the opening in pad eye 25 associated therewith. Once feet 45 are engaged in pad eyes 25, explosive charge 32 is detonated to cause severance at the level of the explosive charge of the three well pipes 10, 12 and 13 and the lower end of tubing 30. Drill pipe 55 is then raised to cause feet 45 to engage pad eyes 25. Once so engaged further raising of drill pipe 55 causes wellhead 11, guide base 17 and the freed upper portions of the severed well pipes to be raised and brought to the water's surface. Temporary guide base 15 may be removed later by conventional means known to those knowledgeable in this art.

As an illustration of typical sizes of the equipment, housing 11A may have a 30 inch outside diameter and housing 11B an 28 inch outside diameter and frame 35 a 30 inch outside diameter. $D_1$ (see FIG. 1) is the distance from the bottom of gussets 36 to the lower end of frame 35 and that is the distance frame 35 will extend over housing 11B, shown as $D_2$, when frame 35 rests on the top of housing 11B. The depth of explosive charge 32 in tubing 13 may be approximately 15 to 20 feet below ocean floor 16 as indicated by the distance $D_3$ of FIGS. 1 and 1A.

If wellhead 11 and guide base 17 are not freed by the detonation of the explosive material, drill pipe 55 is rotated counterclockwise, feet 45 are disengaged or disconnected from the openings in pad eyes 25 and recovery tool 70 is brought to the water's surface. A new nose 33 and centralizer section 31 containing a new explosive charge 32 are attached to the lower end of tubing 30 at the same depth as before and the recovery tool is rerun, reconnected to wellhead 11 and the explosive charge again shot.

More than, or less than, four latching means (legs-feet and pad eyes) may be used. Also, the feet and pad eyes may be reversed so that the feet are arranged on the wellhead and the pad eyes are arranged on the recovery tool. Further, other types of easily engaged-disengaged catches, including hooks such as are formed by feet 45, may be employed in place of the pad eyes.

Other changes and modifications may be made in the illustrative embodiments of the invention shown and described herein without departing from the scope of the invention as defined in the appended claims.

We claim:

1. Apparatus for recovering a subsea guide base and wellhead attached to well pipe suspended in a subsea borehole comprising:

(a) a tubular member extending from above said wellhead into said well pipe;

(b) an explosive arranged in said tubular member;

(c) a frame secured to said tubular member above said explosive and positioned on said wellhead;

(d) a plurality of angularly spaced apart legs secured to said frame;

(e) a foot member connected to each of said legs;

(f) a plurality of angularly spaced apart catches attached to said wellhead, said catches and said foot members being engageable; and (g) said foot members being positioned on said tubular member relative to the location of said catches and the location of said explosive in said tubular member such that said foot members and said catches are aligned and level with said foot members.

2. Apparatus for recovering equipment attached to well pipe suspended in a subsea borehole, said equipment containing latch engaging means comprising:

(a) an elongated member capable of extending from above said equipment into said well pipe;

(b) an explosive arranged in said elongated member;

(c) latch means arranged on said elongated member and spaced from said explosive capable of engaging said latch engaging means for latching said elongated member to said equipment upon rotation of said elongated member, the spacing of said latch means and said explosive being such that when said elongated member is latched to said equipment said explosive is positioned at a predetermined depth in said well pipe;

said latch means on said elongated member comprising a plurality of angularly spaced-apart legs and a foot member connected to each of said legs and said engaging means on said equipment comprising a plurality of angularly spaced-apart catches, said foot members engaging said catches.

3. Apparatus as recited in claim 2 in which said equipment comprises a subsea guide base and wellhead.

4. Apparatus as recited in claim 3 including a frame securing said legs to said elongated member and capable of being lowered onto said wellhead.

5. Apparatus as recited in claim 4 in which said elongated member comprises a tubular member.

6. Apparatus as recited in claim 5 including a drill pipe connecting said tubular member to the water's surface.

7. Apparatus as recited in claim 6 including means extending from the water's surface to said explosive for detonating said explosive.

8. A method for recovering a subsea guide base and wellhead from which a well pipe is suspended in a subsea borehole comprising:

lowering a tubular member, having (a) a plurality of angularly spaced apart legs, (b) a foot member connected to each of said legs, and (c) an explosive spaced below said foot members, from the water's surface to said wellhead, said wellhead having a plurality of catches for engaging said foot members;

guiding said tubular member through said wellhead and into said well pipe until said catches and said foot members are at the same level and in position to be engaged, said explosive being then positioned at a predetermined depth in said well pipe;

rotating said tubular member to engage said foot members and said catches;

detonating said explosive to sever said well pipe; and then raising said tubular member to the water's surface along with said wellhead, guide base and well pipe attached to said tubular member.

9. A method as recited in claim 8 including a plurality of well pipes suspended in said borehole, all of said well pipes being severed by detonation of said explosive.

* * * * *